US005086624A

United States Patent [19]

Matsuoka et al.

[11] Patent Number: 5,086,624

[45] Date of Patent: Feb. 11, 1992

[54] COOLING AND HEATING CONCURRENT OPERATION TYPE OF MULTIPLE REFRIGERATION CYCLE

[75] Inventors: Fumio Matsuoka; Jiro Okajima; Keiko Okuma, all of Kamakura; Ken Tomita, Nagasaki; Yasuo Shibuya, Nagasaki; Mutsumi Nakamura, Nagasaki; Hajime Kitauchi, Nagasaki, all of Japan

[73] Assignee: Mitsubishi Denki Kabushiki Kaisha, Tokyo, Japan

[21] Appl. No.: 608,277

[22] Filed: Nov. 2, 1990

[30] Foreign Application Priority Data

Mar. 7, 1990 [JP] Japan ..... 2-56238

[51] Int. Cl.[5] ..... F25B 13/00

[52] U.S. Cl. ..... 62/160; 62/180; 62/184; 62/228.3; 62/228.5

[58] Field of Search ..... 62/228.3, 228.4, 228.5, 62/228.1, 180, 181, 183, 184, 186, 203, 159, 160, 196.2, 196.3, 196.4, DIG. 17

[56] References Cited

U.S. PATENT DOCUMENTS 4,326,387 4/1982 Friedman ..... 62/DIG. 17
4,439,997 4/1984 Cantley ..... 62/228.3 X
4,499,739 2/1985 Matsuoka et al. ..... 62/212
4,878,357 11/1989 Sekigami et al. ..... 62/160
4,951,475 8/1990 Alsenz ..... 62/228.3 X

FOREIGN PATENT DOCUMENTS 1167561 7/1989 Japan .
1247967 10/1989 Japan .

*Primary Examiner*—Harry B. Tanner
*Attorney, Agent, or Firm*—Oblon, Spivak, McClelland, Maier & Neustadt

[57] ABSTRACT

A cooling and heating concurrent operation type of multiple refrigeration cycle comprises an indoor unit including a variable delivery type of compressor and an outdoor heat exchanger; indoor units including indoor heat exchangers, respectively; triple connection pipes of a high pressure gas pipe, a high pressure liquid pipe and a low pressure gas pipe, the triple connection pipes connecting between the outdoor unit and the indoor units; pressure detection means for detecting the intake pressure of the compressor and the discharge pressure of the compressor; and calculation and control means for comparing two detected values of the intake pressure and the discharge pressure of the compressor with two set values of a set intake pressure and a set discharge pressure, and for making variable controls of the compression capability of the compressor and the heat exchange capability of the outdoor heat exchanger based on the respective deviation values between the respective detected values and the respective set values, which are obtained as the results of the comparison.

1 Claim, 3 Drawing Sheets

COOLING AND HEATING CONCURRENT OPERATION TYPE OF MULTIPLE REFRIGERATION CYCLE

The present invention relates to a cooling and heating concurrent operation type of multiple refrigeration cycle, and more particularly to a cooling and heating concurrent operation type of multiple refrigeration cycle wherein the capability of a compressor and that of an outdoor heat exchanger can be automatically controlled.

Referring to FIG. 3, there is shown a schematic diagram showing the structure of a conventional multiroom type of heating and cooling system as disclosed in e.g. Japanese Unexamined Patent Publication No. 247967/1989. In FIG. 3, reference numeral 1 designates an outdoor unit. Reference numeral 2 designates a compressor. Reference numerals 3*a* and 3*b* designate outdoor heat exchangers. Reference numerals 5*a*, 5*b* and 5*c* designate indoor units. Reference numerals 6*a*, 6*b* and 6*c* designate indoor heat exchanges. Reference numeral 7 designates a refrigerant discharge pipe. Reference numeral 8 designates a refrigerant intake pipe. Reference numerals 9*a*, 9*b*, 10*a* and 10*b* designate switching valves. Reference numeral 11 designates an inter-unit pipe arrangement which includes a high pressure gas pipe 12, a low pressure gas pipe 13 and a liquid pipe 14. Reference numerals 15*a*–15*c* and 16*a*–16*c* designate switching valves. Reference numerals 17*a*–17*c*, and 18*a* and 18*b* designate refrigerant decompression devices.

The operation of the conventional system will be explained.

Suppose that the indoor units 5*a* and 5*b* are under heating operation mode, and that the indoor unit 5*c* is under cooling operation mode. The capability of the compressor 2 is decided to satisfy the requirements of the indoor units 5*a* and 5*b* under the heating operation mode which is greater than the cooling operation mode in load. The capacities of the outdoor heat exchangers 3*a* and 3*b* are determined so that only the outdoor heat exchanger 3*a* undertakes the reminder (5*a*+5*b*–5*c*) which is obtained by subtracting the sum (5*c*) of cooling loads from the sum (5*a*+5*b*) of heating loads with respect to the indoor units 5*a*, 5*b* and 5*c*. In this time, the outdoor heat exchanger 3*a* functions as an evaporator.

For these reasons, the switching valves 15*a* and 15*b* which are related to the high pressure gas pipe 12 are opened, and the switching valve 15*c* which is related to the high pressure gas pipe 12 is closed. The switching valves 16*a* and 16*b* which are related to the low pressure gas pipe 13 are closed. In this case, the refrigerant decompression devices 17*a* and 17*b* which are related to the liquid pipe 14 are fully opened. In the indoor units 5*c* and the outdoor heat exchanger 3*a* which function as evaporators, the refrigerant decompression devices 17*c* and 18*a* function as expansion valves. In the indoor heat exchanger 6*c* and the outdoor heat exchanger 3*a*, a refrigerant is evaporated, and is introduced into the intake tube 8 by opening the switching valves 16*c* and 10*a* to the low pressure gas pipe 13. In that time, the switching valves 9*a*, 9*b* and 10*b* are closed. Because the conventional multiroom type of cooling and heating system has been constructed as stated above, the determination of the capability of the compressor 2 and the capacities of the outdoor heat exchangers 3*a* and 3*b* needs information on the respective indoor units 5*a*, 5*b* and 5*c*. This means that information transmission has to be carried out between the indoor units 5*a*, 5*b* and 5*c*, and the outdoor units 1, creating problems in that a control system is made to be complex, and reliability deteriorates.

It is an object of the present invention to solve the problems, and to provide a new and improved cooling and heating concurrent operation type of multiple refrigeration cycle capable of determining the control of the capability of a compressor in an outdoor unit and the capability of an outdoor heat exchanger based on only the intake pressure and discharge pressure of the compressor, of eliminating information transmission between indoor units and the outdoor unit, of controlling a high pressure for heating and a low pressure for cooling to maintain them constant, and of improving reliability and comfort.

The foregoing and other objects of the present invention have been attained by providing a cooling and heating concurrent operation type of multiple refrigeration cycle comprising an indoor unit including a variable delivery type of compressor and an outdoor heat exchanger; indoor units including indoor heat exchangers, respectively; triple connection pipes of a high pressure gas pipe, a high pressure liquid pipe and a low pressure gas pipe, the triple connection pipes connecting between the outdoor unit and the indoor units; pressure detection means for detecting the intake pressure of the compressor and the discharge pressure of the compressor; and calculation and control means for comparing two detection values of the intake pressure and the discharge pressure of the compressor with two set values of a set intake pressure and a set discharge pressure, and making calculation to obtain the respective deviation values between the respective detected values and the respective set values, and for making variable controls of the compression capability of the compressor and the heat exchange capability of the outdoor heat exchanger based on the respective deviation values which have been obtained as the results of the calculation.

In accordance with the present invention, the intake pressure and the discharge pressure of the compressor are detected at the side of the outdoor unit. Based on the deviation values which are obtained by comparing the detected values with a set intake pressure value and a set discharge pressure value, the compression capability of the compressor and the heat exchange capability of the outdoor heat exchanger can be variably controlled. This arrangement can avoid the need for the transmission of control information between the indoor units and the outdoor unit, and the transmission of control information can be made only at the side of the outdoor unit to make the information transmission easy, thereby offering an advantage in that comfort and reliability are improved.

BRIEF DESCRIPTION OF THE DRAWINGS

One way of carrying out of the invention is described in detail below with reference to drawings which illustrate only one specific embodiment, in which.

DETAILED DESCRIPTION OF THE DRAWINGS

Figure 1:
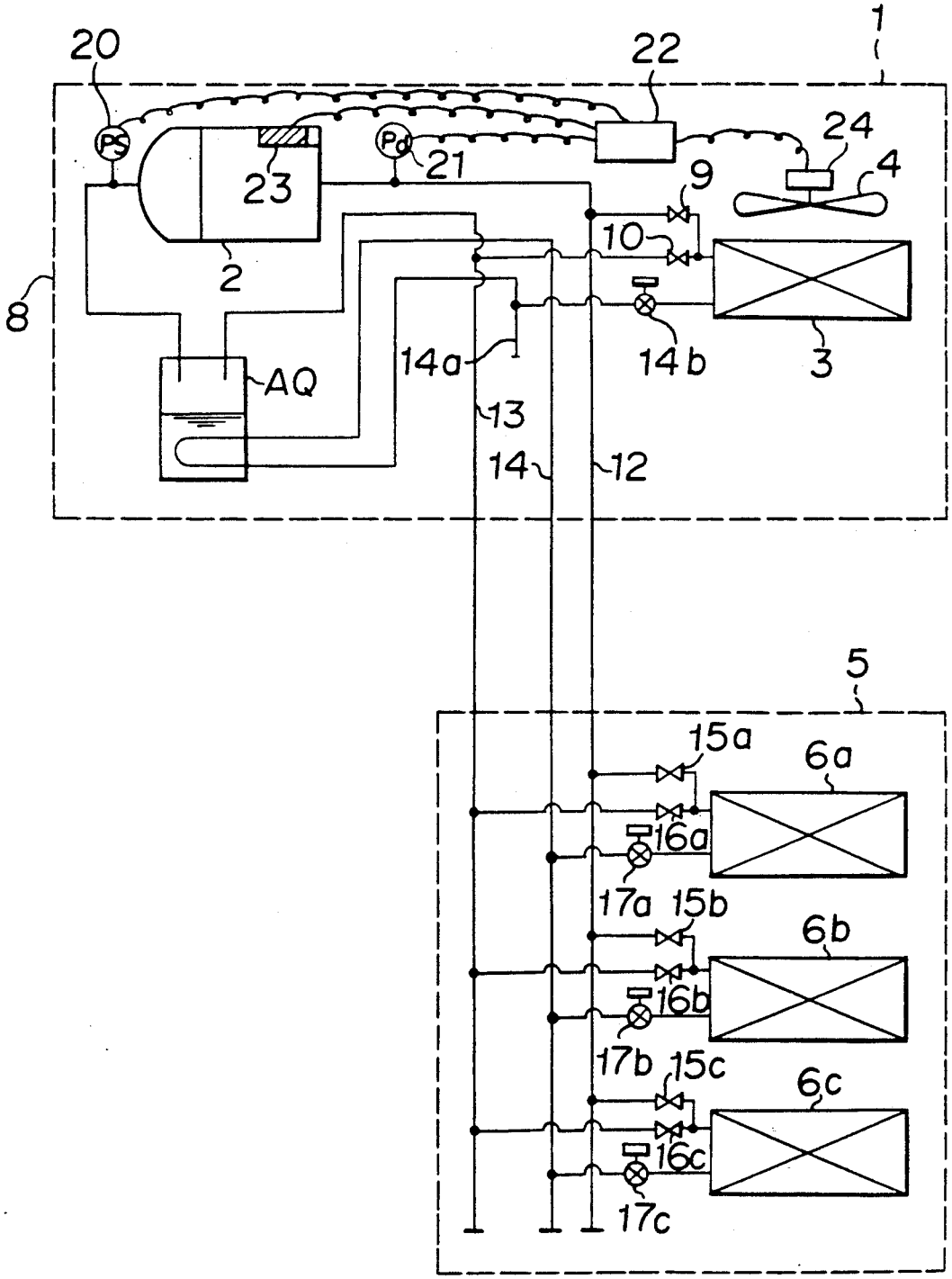
FIG. 1 is a schematic circuit diagram showing the cooling and heating concurrent operation type of multiple refrigeration cycle of an embodiment according to the present invention.
Figure 2:
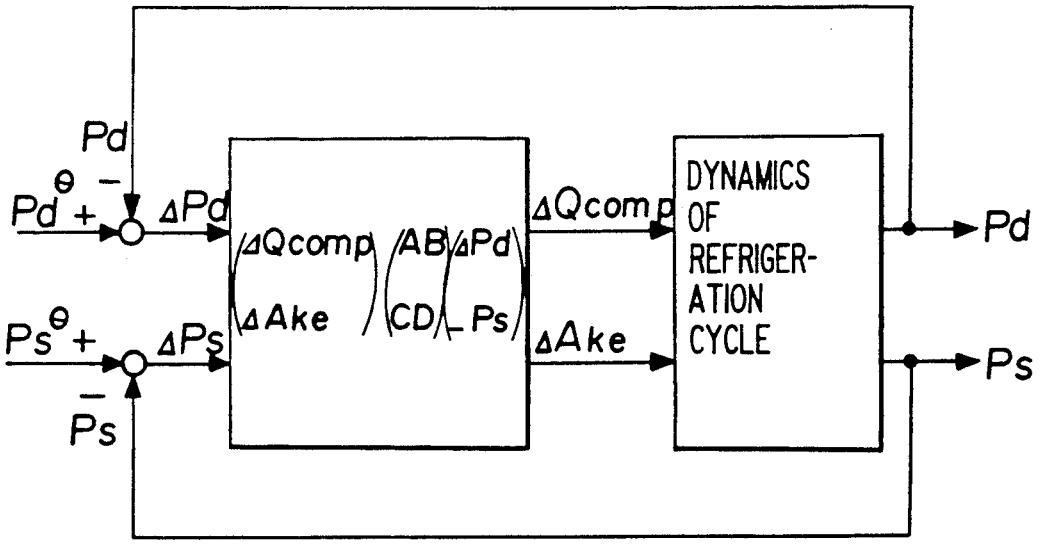
FIG. 2 is a schematic block diagram showing the control which is made in the multiple refrigeration cycle of FIG. 1.
Figure 3:
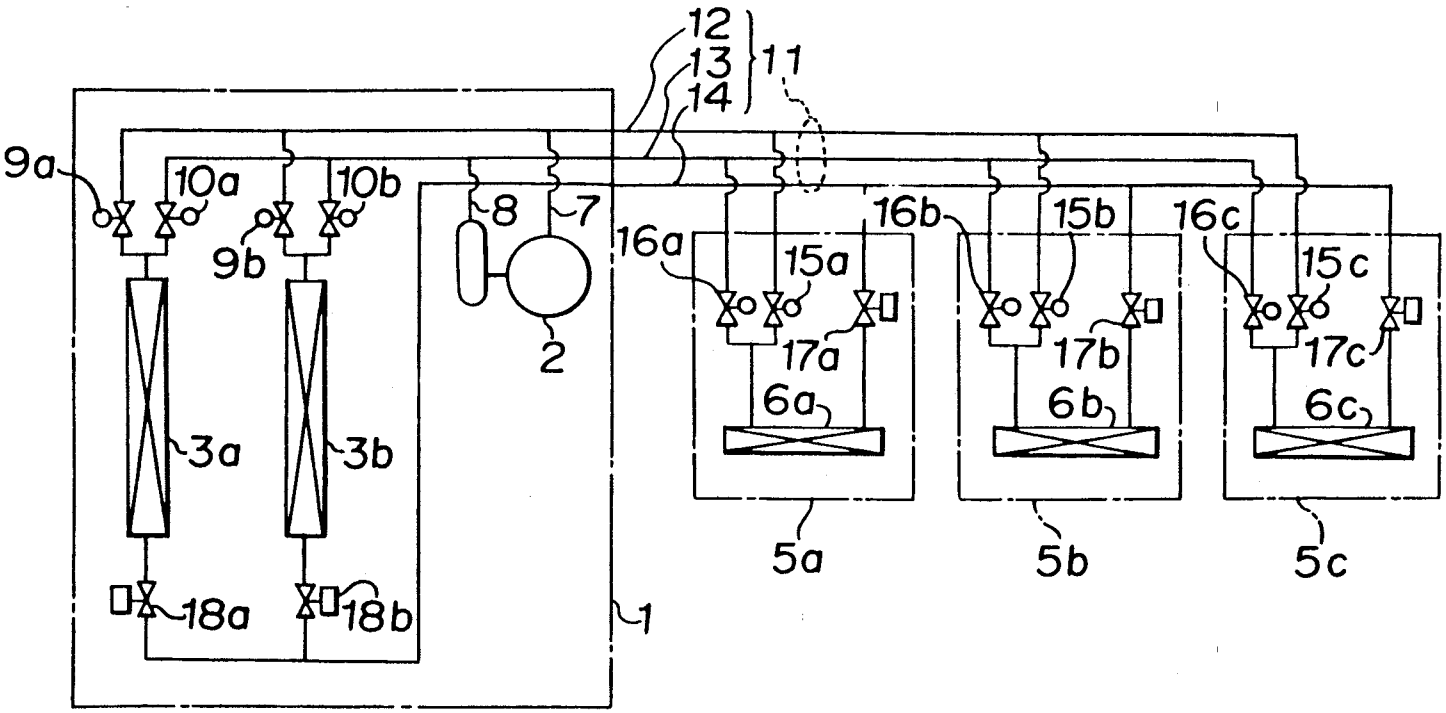
FIGURE 3 PRIOR ART
FIG. 3 is a schematic diagram showing the structure of the conventional multiroom type of cooling and heating system.

Referring now to the drawings, wherein like reference numerals designate identical or corresponding parts throughout the several views, and more particularly to FIG. 1 thereof, there is shown a schematic circuit diagram of a typical example of the cooling and heating concurrent operation type of multiple refrigeration cycle according to the present invention. In FIG. 1, reference numeral 1 designates an outdoor unit. Reference numeral 2 designates a variable capability control type of compressor. Reference numeral 3 designates an outdoor heat exchanger. Reference numeral designates a fan for the outdoor heat exchanger 3. Reference numeral 5 designates a group of indoor units. Reference numerals 6*a*, 6*b* and 6*c* designate indoor heat exchangers. Reference numeral 8 designates an intake pipe which connects between the intake side of the compressor 2 and an accumulator AQ which carries out heat exchange between a high pressure liquid pipe 14 and a low pressure gas pipe 13. Reference numeral 9 designates a solenoid on-off valve which is arranged in a connection pipe between the outdoor heat exchanger 3 and a high pressure gas pipe 12 which will be described later on. Reference numeral 10 designates a solenoid on-off valve which are arranged in a connection pipe between the outdoor heat exchanger 3 and the low pressure gas pipe 13 which will be stated in more detail later on. Reference numeral 12 designates the high pressure gas pipe which is connected to the discharge side of the compressor 2. Reference numeral 13 designates the low pressure gas pipe which is connected to the accumulator AQ. Reference numeral 14 designates the high pressure liquid pipe which is arranged to pass through the accumulator AQ. Reference numeral 14*a* designates a high pressure subcool pipe which is an extension of the high pressure liquid pipe 14 and which is subjected to subcool in the accumulator AQ. Reference numeral 14*b* designates an electronic expansion valve which is arranged in a connection pipe between the high pressure subcool pipe 14*a* and the outdoor heat exchanger 3. Reference numerals 15*a*, 15*b* and 15*c* designate solenoid on-off valves which are respectively arranged in connection pipes between pressure gas pipe 12. Reference numerals 16*a*, 16*b* and 16*c* designate solenoid on-off valves which are respectively arranged in connection pipes between the gas pipe 13. Reference numerals 17*a*, 17*b* and 17*c* designate electronic expansion valves which are respectively arranged in connection pipes between the indoor heat exchangers 6*a*, 6*b* and 6*c* and the high pressure liquid pipe 14. Reference numeral 20 designates an intake pressure detector which functions as a pressure detection device for detecting the intake pressure at the intake side of the compressor 2. Reference numeral 21 designates a discharge pressure detector which functions as a pressure detector device for detecting the discharge pressure at the discharge side of the compressor 2. Reference numeral 22 designates a calculation and control device which have two detection values of intake pressure detection value and discharge pressure detection value inputted from the intake pressure detector 20 and from the discharge pressure detector 21, which compares these two detection values with two set values of set intake pressure value and set discharge pressure value, and makes necessary calculation, and which outputs a compressor control signal and a fan control signal based on the deviation values which are obtained as the results of the comparison and calculation. Reference numeral 23 designates a compressor capability changing device which receives the compressor control signal from the calculation and control device 22, and which can change the capability of the compressor 2. Reference numeral 24 designates a revolution changing device which receives the fan control signal from the calculation and control device 22, and which can change the revolution of the fan 4.

The operation of the embodiment will be explained. Suppose that the indoor heat exchangers 6*a* and 6*b* in the indoor unit group 5 are under heating operation, and that the indoor heat exchanger 6*c* is under cooling operation.

A high pressure gaseous refrigerant which has been discharged from the compressor 2 passes through the high pressure gas pipe 12, and enters the indoor heat exchangers 6*a* and 6*b* through the solenoid on-off valves 15*a* and 15*b*. In the indoor heat exchangers 6*a* and 6*b*, the gaseous refrigerant is condensed and liquefied to become a liquid refrigerant having high pressure. The liquid refrigerant enters the high pressure liquid pipe 14 through the electronic expansion valves 17*a* and 17*b* which are fully opened. The high pressure liquid refrigerant which has entered the high pressure liquid pipe 14 enters the indoor heat exchanger 6*c* through the electronic expansion valve 17*c*. At that time, the liquid refrigerant is decompressed and expanded by the electronic expansion valve 17*c*, and then flowed into the indoor heat exchanger 6*c*. In the heat exchanger 6*c*, the liquid refrigerant is evaporated to become a gaseous refrigerant. After that, the gaseous refrigerant enters the low pressure gas pipe 13 through the solenoid on-off valve 16*c*. The gaseous refrigerant is directed to the outdoor unit 1 by the low pressure gas pipe 13, and returns to the compressor 2 through the accumulator AQ. In this way, the circulation passage of the refrigerant is formed. When there is one cooling unit (the indoor heat exchanger 6*c*) and two heating units (the indoor heat exchangers 6*a* and 6*b*) as stated above, the higher pressure (the discharge pressure of the compressor 2) Pd of the refrigerant which flows through the high pressure gas pipe 12, and the lower pressure (the intake pressure of the compressor 2) Ps of the refrigerant which flow through the low pressure gas pipe 13 and the intake pipe 8 are at low levels with respect to a target higher pressure (set higher pressure) $Pd\theta$, and a target lower pressure (set lower pressure) $Ps\theta$, respectively. The intake pressure Ps of the compressor 2 is detected by the intake pressure detector 20, and the discharge pressure Pd of the compressor 2 is detected by the discharge pressure detector 21. These two detected values Ps and Pd are outputted to the calculation and control device 22. The calculation and control device 22 calculates deviations of $\Delta Pd = Pd\theta - Pd$ and $\Delta Ps = Ps\theta - Ps$ based on the two inputted detected values Ps and Pd, and the set pressure values $Ps\theta$ and $Pd\theta$. Based on the deviation values which are obtained by the calculation, a capability changing amount $\Delta Q_{comp}$ required for the compressor 2, and a heat exchange capability changing amount $\Delta AKe$ required for the outdoor heat exchanger 3 are found in accordance with the following formula:

$$\begin{pmatrix} \Delta Q_{comp} \\ \Delta AKe \end{pmatrix} = \begin{pmatrix} A & B \\ C & D \end{pmatrix} \begin{pmatrix} \Delta Pd \\ \Delta Ps \end{pmatrix}$$

The essence of the formula is that when the capability of the compressor is increased by $\Delta Q_{conp}$, the higher pressure is increased by a and the lower pressure is decreased by $-b$, and that when the capability of the heat exchanger as an evaporator is increased by ΔAKe, the higher pressure is increased by c and the lower pressure is also increased by d.

In other wards, the following equations are established:

$$\Delta Pd = a \cdot \Delta Q_{comp} + c \cdot \Delta AKe$$

$$\Delta Ps = -b \cdot \Delta Q_{comp} + d \cdot \Delta AKe$$

As a result, the following formula is obtained:

$$\begin{pmatrix} \Delta Pd \\ \Delta Ps \end{pmatrix} = \begin{pmatrix} a & c \\ -b & d \end{pmatrix} \begin{pmatrix} \Delta Q_{comp} \\ \Delta AKe \end{pmatrix}$$

The formula stated above can be expressed in an inverse form as follows:

$$\begin{pmatrix} \Delta Q_{comp} \\ \Delta AKe \end{pmatrix} = \begin{pmatrix} a & c \\ -b & d \end{pmatrix}^{-1} \begin{pmatrix} \Delta Pd \\ \Delta Ps \end{pmatrix}$$

$$= \frac{1}{ad + bc} \begin{pmatrix} d & -c \\ b & a \end{pmatrix} \begin{pmatrix} \Delta Pd \\ \Delta Ps \end{pmatrix}$$

$$= \begin{pmatrix} A & B \\ C & D \end{pmatrix} \begin{pmatrix} \Delta Pd \\ \Delta Ps \end{pmatrix}$$

As stated earlier, the calculation and control device 22 finds the capability changing amount $\Delta Q_{comp}$ required for the compressor 2, and the heat exchange capability changing amount ΔAKe required for the outdoor heat exchanger 3 based on the deviation values which are obtained as the results of the calculation. The calculation and control device 22 outputs to the compressor capability changing device 23 a compressor control signal indicative of the compressor capability changing amount $\Delta Q_{comp}$, and also outputs to the rotation changing device 24 a fan control signal indicative of the heat exchange capability changing amount ΔAKe in order to control the respective operations of the compressor 2 and the fan 4.

We claim:

1. A cooling and heating concurrent type of multiple refrigeration cycle comprising:

an outdoor portion containing an outdoor heat exchanger and a variable delivery type of compressor having an intake and output;

a plurality of indoor units having indoor exchangers;

triple connection pipes comprising a high pressure gas pipe, a high pressure liquid pipe and a low pressure gas pipe, said triple for connecting said outdoor unit and said indoor units;

pressure detecting means located in said outdoor portion and at the output and input to said variable delivery type of compressor for detecting the input and output pressure of said variable delivery type compressor; and calculation and control means for comparing the detected input and output pressure of said variable delivery type compressor at the intake and output therefrom with two predetermined set values and making a calculation to obtain a respective deviation value between the respective detected values and said predetermined capability of said compressor and the heat exchange capability of said outdoor heat exchanger based upon the deviation produced by said calculation.

* * * * *